US007005016B2

(12) United States Patent
Turi et al.

(10) Patent No.: US 7,005,016 B2
(45) Date of Patent: Feb. 28, 2006

(54) HOT ROLLED STEEL HAVING IMPROVED FORMABILITY

(75) Inventors: Maria-Lynn Turi, Stoney Creek (CA); Stephen Lynes, Burlington (CA)

(73) Assignee: Dofasco Inc., Hamilton (CA)

( * ) Notice: Subject to any disclaimer, the term of this patent is extended or adjusted under 35 U.S.C. 154(b) by 127 days.

(21) Appl. No.: 10/023,936

(22) Filed: Dec. 21, 2001

(65) Prior Publication Data

US 2002/0053374 A1 May 9, 2002

Related U.S. Application Data

(63) Continuation-in-part of application No. 09/496,290, filed on Feb. 1, 2001.

(30) Foreign Application Priority Data

Jan. 7, 2000 (CA) ..... 2293995

(51) Int. Cl.
*C21D 8/10* (2006.01)
*C21D 7/13* (2006.01)

(52) U.S. Cl. ..... 148/540; 148/508; 148/330; 148/648; 148/546

(58) Field of Classification Search ..... 148/330, 148/507, 540, 546, 320, 508, 648; 420/126, 420/128

See application file for complete search history.

(56) References Cited

U.S. PATENT DOCUMENTS 4,001,052 A 1/1977 Nakazato et al.
4,375,376 A 3/1983 Rowden et al.
4,938,266 A 7/1990 Tomita et al.
4,952,250 A 8/1990 Matsumoto et al.
5,695,576 A 12/1997 Beguinot
5,873,957 A 2/1999 Bano et al.
5,948,183 A 9/1999 Okada et al.
6,007,644 A 12/1999 Ohmori et al.
6,162,307 A * 12/2000 Hasegawa et al. ..... 148/334

FOREIGN PATENT DOCUMENTS

DE 2544947 9/1977

OTHER PUBLICATIONS

Yamamoto, Koichi et al., "Formation Mechanism and Prevention Method of Facial Cracks of Continuously Cast Steel Slabs Containing Boron".
N. Takahashi et al., "Baron-Bearing Steels for Continuous Annealing to Produce Deep Drawing and High Strength Steel Sheets". p. 133-153.

* cited by examiner

*Primary Examiner*—George Wyszomierski
*Assistant Examiner*—Janelle Morillo
(74) *Attorney, Agent, or Firm*—Santosh K. Chari; Blake, Cassels & Graydon LLP.

(57) ABSTRACT

A method of producing hot rolled steel having improved formability and minimal silver formation comprises the addition of Titanium and Boron to the molten steel to combine with and remove the free nitrogen prior to rolling. Titanium is added so that the amount of nitrogen remaining after Ti addition is about 0.0005 wt % to about 0.0025 wt % and Boron is added to remove the balance of the nitrogen by forming BN.

6 Claims, 4 Drawing Sheets

HOT ROLLED STEEL HAVING IMPROVED FORMABILITY

RELATED APPLICATIONS

This is a continuation-in-part of application Ser. No. 09/496,290 filed Feb. 1, 2001; the entire contents of which is incorporated herein by reference.

FIELD OF THE INVENTION

The present invention relates to hot rolled steel having improved formability and lower slivering. Such steel has become increasingly in demand for many uses requiring high formability, including hydroforming wherein a steel having a high quality and improved formability is needed.

BACKGROUND OF THE INVENTION

Low Carbon Aluminium Killed (LCAK), hot rolled steel sheets are commonly known and are used for the manufacture of a wide range of products such as steel pipes, tubes and automotive stampings etc. Many processes have been developed for making such steel sheets. These processes have focused primarily on increasing the yield strength of the resulting steel so as to impart high strength to the final product.

Examples of such processes are provided in U.S. Pat. Nos. 4,938,266 and 5,948,183, which are incorporated herein by reference. In each of these references, a process for making hot rolled steel sheets is provided. However, each of the processes is designed to provide steels with high strength. These references teach the use of various additives to assist the subject process. For example, Boron (B) is added to improve the hardenability of the steel since it prevents the excessive growth of crystal grains and prevents the precipitation of coarse carbides at high temperatures. Titanium (Ti) is another known additive that has been found to increase steel strength by precipitating dissolved Carbon to form Titanium carbide. However, for both B and Ti, a concentration exists below which the strength of the steel is reduced. With the advent of hydroforming processes, there has been a demand for high quality steel tubes that are more formable, i.e. having inter alia lower yield strength. Similarly, as automotive stampings become more complex, demand for higher formability (i.e. lower yield strength and higher elongation) steel has increased. In manufacturing low yield strength steel, it has been found that reducing free nitrogen is a contributing factor. One method of preparing such steel involves the addition of an element that precipitates the free nitrogen as a nitride. Examples of such additives are Aluminium, Titanium, Zirconium and Boron.

A major problem associated with the use of Boron is that the additions necessary to increase the formability of steel, also result in the formation of cracks in the cast slabs at a level significantly higher than typical with Boron free steel. These cracks develop into iron oxide defects also known as "slivers" in the final steel coil. Modifications to the casting process do not eliminate these defects. This results in a lower quality of steel. To remove the slivers, it is common to "scarf" the slabs (i.e. remove surface layer of steel) or to "slit" the resulting steel strip; i.e. reduce the width. In either case, a substantial yield loss is incurred and the processing time for the steel is increased.

Boron also results in increased rolling loads, which may cause hot-rolling problems such as crimps and folds that may limit the width that can be rolled in the hot mill.

The use of Boron and Titanium in steel has been known for many years but such use has been in a difference context.

As mentioned above, Boron is a very strong strengthener of steel. It has been used in ultra low Carbon steels, low Carbon steel and medium Carbon steel to give high strength. In order to achieve the strengthening effect, all free nitrogen must be removed. For this reason, sufficient or excess Titanium is added to combine with the nitrogen in the steel. This leaves the added Boron free to harden the steel. Although it is possible to harden steel by using less Titanium and more Boron, slab cracking results. Thus, for hardening steel, excess Titanium is used. A minimum amount of Boron is required to obtain the desired hardening effect, and this depends on the Carbon content.

The other application of Boron in a Titanium bearing steel is as an element used to control secondary work embrittlement in cold-rolled annealed interstitial-free (IF) steel. It is not added to lower yield strength in these steels. Titanium and/or niobium are added in sufficient quantities to remove all the nitrogen (N), all the Carbon (C) and all the sulphur (S) in de-gassed steel that has a very low N, C and S. However, the absence of interstitial elements such as Carbon makes the steel susceptible to cracking at grain boundaries during room temperature stamping. The addition of a few parts per million of Boron significantly decreases the temperature of transition from ductile fracture to brittle fracture. The level of Boron used for this application is far below the ranges used for softening LCAK (Low Carbon Aluminium Killed) steel These steels are also cold-rolled and annealed after hot rolling.

Titanium has strong infinity for oxygen. Thus, it can be used to remove oxygen from liquid steel in the same way that Aluminium is used. U.S. Pat. No. 4,001,052 for formable Boron-bearing steel teaches that Titanium, Zirconium or Aluminium could be used "kill" steel; i.e. remove oxygen from the molten steel. Boron was added to soften the steel. From a practical standpoint, Zirconium or Titanium would not be used to kill steel because the large quantities required would make either one prohibitively expensive. This patent expressed the Boron and Titanium contents as simple ranges and will result in some chemistries highly susceptible to cracking, others will have high rolling loads and others reduced formability as compared to non-Boron/Titanium alloyed steel.

Various other elements have been added to molten steel in addition to Boron and Titanium to improve the mechanical properties of steel. U.S. Pat. No. 6,007,644 teaches the manufacture of a high toughness and yield strength steel having a minimum yield strength of 325 Mpa (equivalent to 47.14 ksi). The yield strength is achieved by adding Vanadium (V) in addition to Titanium (Ti) to the molten steel. The Titanium is added to produce fine TiN precipitates which serve as nucleation sites for vanadium nitride, both of which are added to refine the austenite grain size which results in increased yield strength. However, given the range of nitrogen in the steel and the range of Titanium specified, the steel produced will result in inconsistent strength and frequent slivers when Boron is also present in this steel.

Another application of Boron in a Titanium bearing steel, as described in U.S. Pat. No. 4,375,376 is as an element for retarded aging in a cold rolled high yield strength steel product. The Boron is added most conveniently as solid particles of ferro-Boron. Titanium and Boron have also been added in the presence of phosphorous to produce deep drawing and high strength steel sheets by continuous annealing (Takahashi et al.).

Thus, while the above processes have focused primarily on increasing the yield strength of the resulting steel, there still exists a need for an improved method for making hot rolled steel having increased formability with a defect level not significantly different from non-Boron alloy steel.

SUMMARY OF THE INVENTION

In one embodiment, the present invention provides a method of producing a low yield strength hot rolled steel sheet having a yield strength of less than about 43 ksi from molten steel, said sheet having increased formability and low slivering, the method comprising the steps of;

a) measuring the total nitrogen concentration of the molten steel;

b) adding a sufficient amount of Titanium to the molten steel to bind with the first portion of the total nitrogen forming TiN, thereby leaving a second portion of total nitrogen;

c) adding a sufficient amount of Boron to the molten steel to bind with the second portion of total nitrogen to form BN; and d) hot rolling the steel In another embodiment, the invention provides a hot rolled steel sheet having a first portion and a second portion of total nitrogen wherein the first portion is combined in the form of TiN and the second portion is combined in the form of BN.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
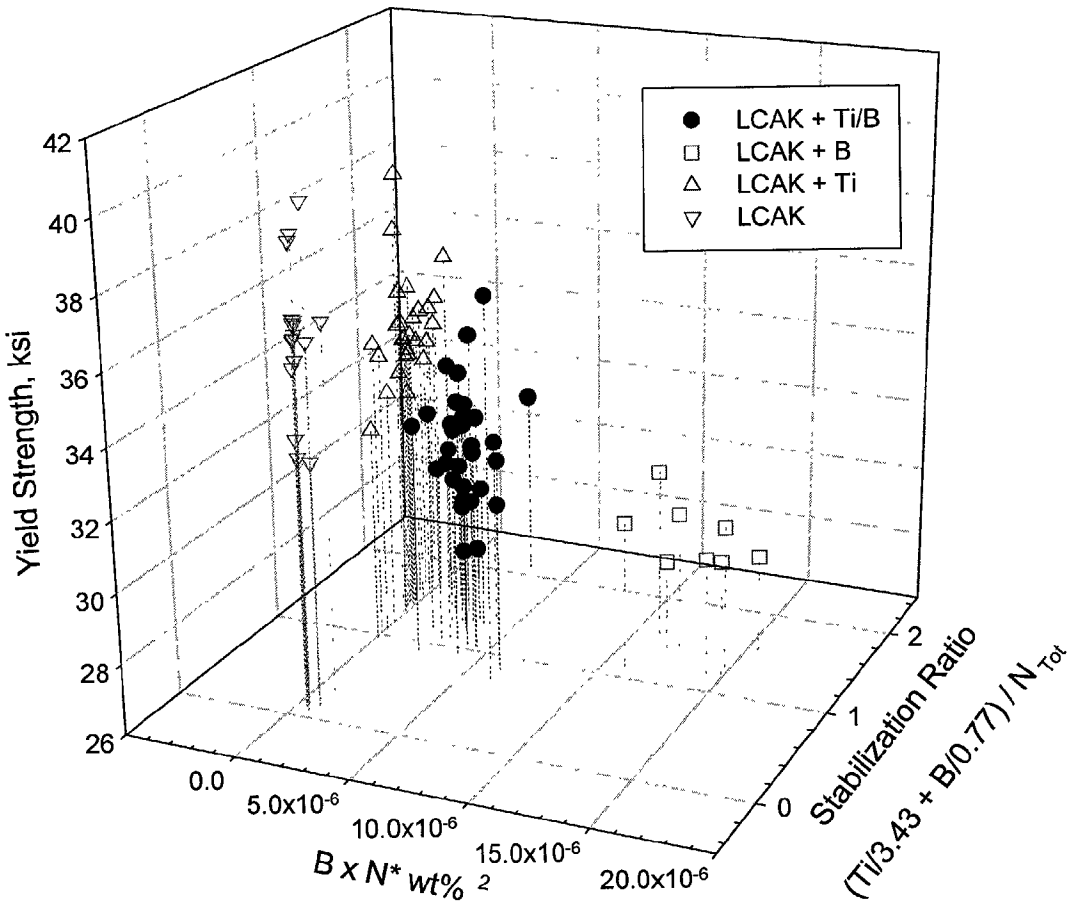
FIG. 1 is a graph illustrating the yield strength values of hot rolled steel trials as a function of the stabilization ratio and Boron bound to free excess nitrogen.

As discussed above, one of the objects of the present invention is to provide a method or process that results in a hot rolled steel having improved formability while reducing the formation of iron oxide defects that have been encountered in other low strength steels. By "improved formability" it is meant that the steel has lower yield strength, higher total elongation, and a higher "n-value". The n-value represents the work hardening parameter, which is a direct measure of formability.

Generally speaking, yield strength and formability (n value and elongation) are directly related. Decreases in yield strength are generally accompanied by increases in formability. An exception to this is when a decrease in yield strength is achieved by either tension levelling or temper rolling. In these instances, mechanical deformation causes slight decreases in formability concurrent with a decrease in yield strength. Tension levelling is used since it reduces yield strength. Therefore, it is used in situations where a low yield strength specification is required. However, to make tubes, tension levelling is not advised because it reduces the n-value, which is important in tube manufacture. Therefore, in the preferred embodiments of the invention, tension-levelling elongation of between about 0% to 1.5% is used. In the preferred embodiments, a tension levelling elongation of about 0.5% is used for flat roll sheets and about 0% is used for tube applications.

To achieve the above desired qualities, the present invention provides a novel combination of Titanium (Ti) and Boron (B) in amounts that are related to the total nitrogen concentration of the molten steel. In general terms, the invention provides a method wherein a first portion of the total nitrogen in the molten steel mixture is removed by combining it with Ti to form TiN and wherein the balance of the nitrogen is removed by combining it with B to form BN. By "removing" nitrogen it is meant that the Ti or B being added binds with the respective portion of nitrogen to form TiN and BN respectively thereby removing free N from the mixture.

In a preferred embodiment of the present invention, Ti is used to partially stabilize the nitrogen by first forming TiN, and then B is used to combine with the remaining N to achieve the desired softening effect. By thus controlling the amount of free nitrogen with appropriate Ti and B additions, it is possible to simultaneously reduce or eliminate cracks in the formed steel that are the source of the slivers, improve formability (as defined above), and reduce hot-rolling problems.

With the process of the present invention, it is possible to produce the steel with the desired mechanical properties while maintaining high productivity (low production problems), high yield (no losses from scaring or slitting) and high steel quality (low risk of slivers).

In general terms, the method of the present invention involves measuring the amount of total nitrogen in the molten steel and adding an amount of Ti to form TiN so that the amount of nitrogen remaining after Ti addition, N*, is about 0.0005 wt % to about 0.0025 wt %. This step serves to partially "stabilize" the dissolved nitrogen prior to addition of B. The balance of the total nitrogen is then removed by combining same with B to form BN.

The measurement of the total nitrogen level is done at the ladle metallurgy furnace (LMF). In the preferred embodiment, the steel is also "killed" with Al at the LMF; that is, free oxygen is removed, prior to Ti and B additions, thereby preventing the formation of unwanted compounds such as $B_2O_3$. It should also be mentioned that various other required or desired additives (e.g. Mn) are also added to the molten steel at the LMF. Such additives are well known in the art. More specifically, in the preferred embodiment, the following steps are followed at the LMF;

1) Al is added in sufficient amounts to remove free oxygen in the molten steel;

2) The amount of total nitrogen, $N_{tot}$ is measured;

3) Titanium is added to remove one portion of the total nitrogen, $N_{tot}$. Preferably, Ti is added so that the amount of nitrogen remaining after Ti addition, N* is within the following range;

$$0.0005 \text{ wt } \% \leqq N^* \leqq 0.0025 \text{ wt } \%$$

and more preferably within the following range:

$$0.0012 \text{ wt } \% \leqq N^* \leqq 0.0022 \text{ wt } \%$$

where wt % as used herein is defined as the percent of total element concentration and where N* is the concentration of free nitrogen remaining in solution after TiN precipitation and is calculated based on the following formula:

$$N^*=N_{tot}-(Ti/3.42)$$

Where:

$N_{tot}$ is the amount of the total nitrogen as measured

Ti is the amount of Titanium added

Boron is then added to the molten mixture to remove the N* remaining in the mixture (i.e. to form BN). According to a preferred embodiment, B is added so as to provide a total concentration in the molten mixture that is within the following range:

$$0.0005 \text{ wt } \% \leqq B \leqq 0.0025 \text{ wt } \%$$

and more preferably within the range of:

$$0.001 \text{ wt } \% \leqq B \leqq 0.002 \text{ wt } \%$$

As indicated above, the role of B is to remove free N remaining after Ti addition, N*, by forming BN. A Stabilization Ratio (SR), which is defined as the atomic ratio of the elements responsible for precipitating nitrogen versus the total nitrogen can be represented mathematically as:

$$SR=(B/0.77+Ti/3.42)/N_{tot}$$

Thus, B helps to stabilise the dissolved nitrogen and provides the desired softening of the steel. If the nitrogen is fully stabilised with Ti, then the resulting precipitates, TiN, can be very fine thereby increasing the strength of the steel. Therefore, one of the requirements, according to the preferred embodiments of the invention, for obtaining a soft Ti/B steel is to control the volume fraction and size distribution of the TiN precipitate. It has been determined that B increases grain size while Ti refines it. Coarser grain size results in lower yield strength, which is believed to be one effect of B. It has also been determined that the coarsening still occurs in situations where insufficient B is present to remove all the nitrogen remaining after Ti addition, N*. However, softening when a Boron bearing steel is overstabilized with Ti is known to be erratic, and highly dependent on processing conditions. Careful choice of processing, and control of chemistry would be required to avoid hardening the steel by excess B, an effect commonly known in the literature.

Table 1 provides the results of various experimental trials. The results shown in Table 1 are also illustrated in the attached figures.

The above relationships and preferred ranges are illustrated in FIG. 1 wherein the yield strength values of the hot rolled steel trials are plotted as a function of the SR and Boron bound to N* (B×N*). The preferred range for the SR for the steel of the invention described herein is $0.7 \leqq SR \leqq 2$. The preferred range for the Boron bound to N* is 0 wt $\%^2 < B \times N^* \leqq 4.5 \times 10^{-6}$ wt $\%^2$.

Figure 2:
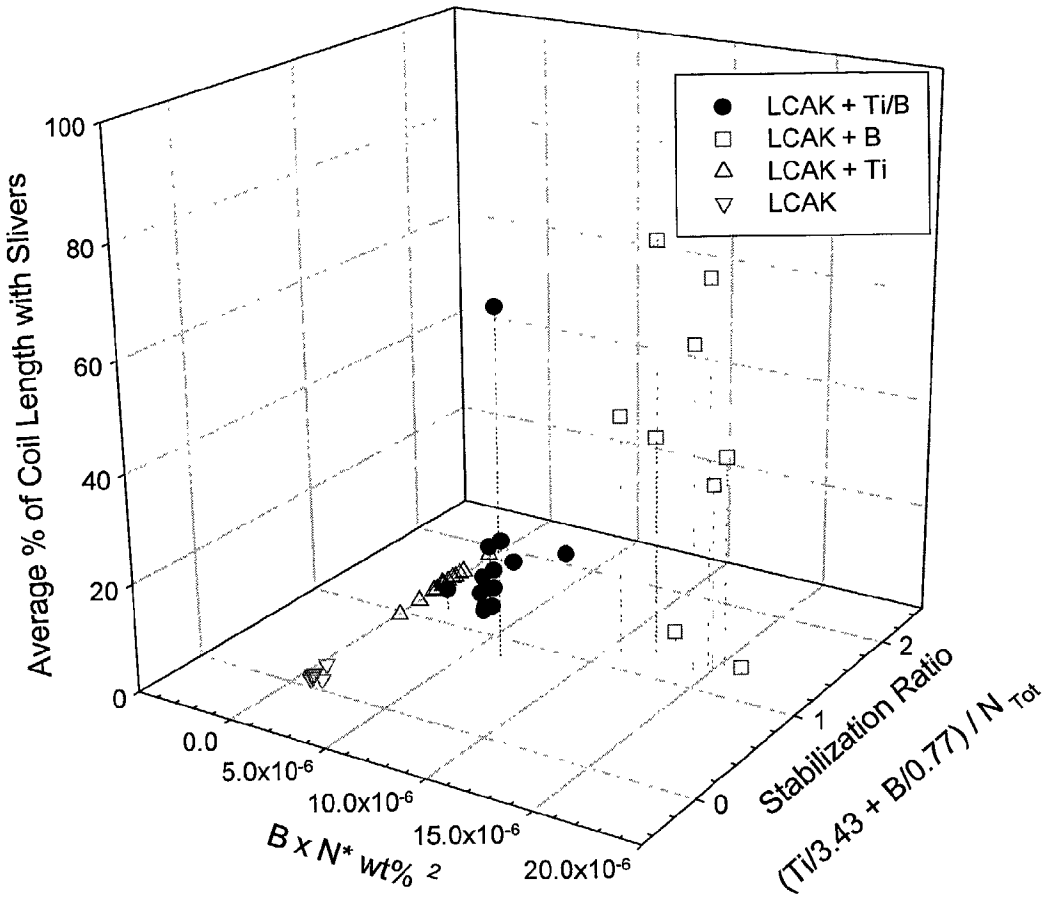
FIG. 2 is a graph illustrating the frequency of slivers as a function of the stabilization ratio and Boron bound to free excess nitrogen of the trials shown in FIG. 1.
Figure 3:
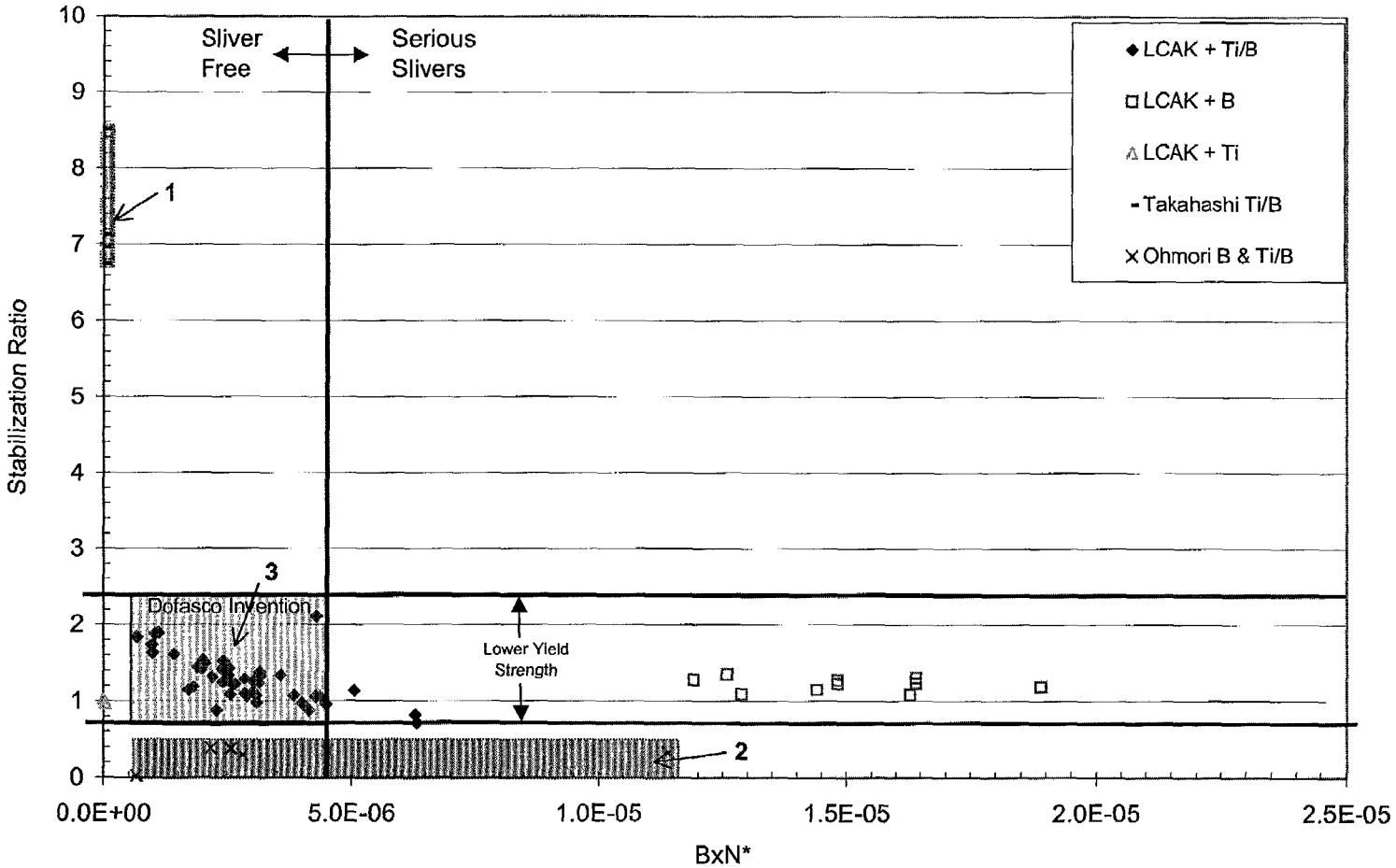
FIG. 3 is a graph illustrating the chemistries of the prior art steels described herein and of the steel of the invention described herein.
Figure 4:
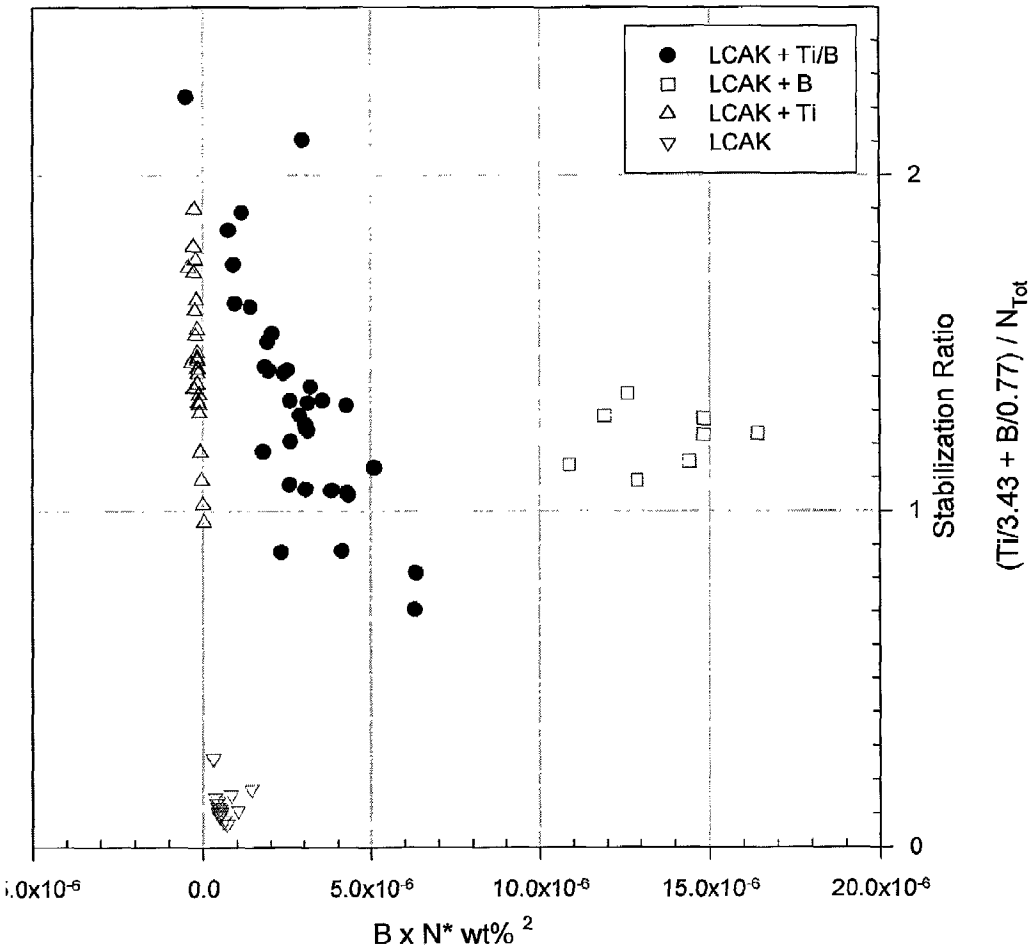
FIG. 4 is a developed view of the lower left quadrant of the graph of FIG. 3.

As can be seen, the preferred ranges of SR and B×N* result in the desired lowering of the yield strength. Although lower yield strengths were found for trials outside of the range of the preferred embodiments of the invention, the steel produced was found to include an undesirable amount of silver formation. As discussed above, one of the desired characteristics of the steel produced by the invention is that the occurrence of silvers is reduced or eliminated. FIGS. 2, 3 and 4 illustrate that within the preferred ranges of SR and B×N*, not only is silver frequency reduced, a low yield strength steel is also obtained.

FIG. 3 is a comparison of the chemical and mechanical properties of the steels produced by the method and prior art steels described herein. It is clear from the graph that composition of the steel 2 taught in U.S. Pat. No. 6,007,644, and of the steel 1 of Takahashi et al. do not fall within the boundaries of the composition of the steel 3 taught herein.

FIG. 4 clearly illustrates that within the preferred ranges of the SR and B×N*, a low yield-strength steel of the present invention having reduced slivers is obtained.

As can be seen in Table 1, the steel made according to the method of the present invention has the desired characteristics of improved formability and reduced silvering.

Other factors should also be considered during processing of the steel according to the preferred embodiment. For example, during the casting step, a caster cooling pattern should be chosen such that the surface temperature during bending and unbending is maximised.

Further, finishing or hot rolling temperature should generally be above Ar3, which is the temperature wherein austenite transforms to ferrite. This temperature is generally known to persons skilled in the art. Therefore, in the preferred embodiment, the hot rolling temperature should be between about 850° C. and about 910° C., and more preferably about 890° C. Higher temperatures would also be applicable, however, it is difficult to achieve this for light gauge steels because of heat loss during finish rolling. As will be known in the art, such heat loss occurs from descaling, contact with the roller, contact with cooling water, radiant losses, speed of the mill etc.

During the cooling stage on the run-out table, a standard spray patterns would be acceptable; however, a spray pattern that gives a low cooling rate is preferred.

The preferred embodiment involves a Distributed Quench step wherein water is added gradually rather than an Early Quench where all the water sprays near the exit of the finishing mill are turned on.

In the preferred embodiment, the coiling temperature is between about 600° C. and about 700° C. and more preferably about 650° C.

Preferably, during the pickling stage, a small tension is applied to remove yield point elongation and to further reduce yield strength.

As discussed above, acceptable tension levelling elongation is between about 0% and about 1.5%. Preferably, this value is about 0.5% for flat rolled sheets and about 0% for tubes.

Further, tension levelling generally results in a decrease in both formability and yield strength. Non tension-levelled material would generally exhibit slightly higher elongation and n-value and slightly higher yield strength. The data presented above are for tension levelled materials only. In the trials that were run on steel grades containing B without Ti, tension levelling was found to reduce yield strength by about 3.1 ksi and decrease n-values by about 0.013 relative to steel that has no tension levelling. No statistically significant effect was observed for tensile strength or total elongation.

In the Ti and B containing grade, tension levelling reduced yield strength by about 3.7 ksi, reduced total elongation by about 1.7% and reduced n-value by about 0.012. Thus, for material that is not tension levelled (or temper rolled), the yield strength and n-value are both higher as expected. Total elongation is difficult to assess, as it is very sensitive to testing conditions and damage to the samples. Therefore, the 1.7% difference may not be significant.

Aluminium can also be added to remove oxygen by forming $Al_2O_3$ which is insoluble in acid. When there is more Al than necessary to remove all the oxygen and there is no free B, the remaining Al forms AlN, which is soluble in acid. There may also be free Al, this is also considered to be soluble Al. When neither Ti nor B is used to stabilise N, the amount of soluble Al (i.e. that which may form AlN) is very important, since it is important to stabilize all the free nitrogen with Al. Free nitrogen causes increased yield strength, susceptibility to aging (increasing yield strength with time), and "break marks," (a defect which ruins the surface finish of the final part).

Although the invention has been described with reference to certain specific embodiments, various modifications thereof will be apparent to those skilled in the art without departing form the spirit and scope of the invention as outlined in the claims appended hereto.

TABLE 1

| | | |
|---|---|---|
| Processing | | |
| Grade Type | LCAK | LCAK + Ti |
| Grade | CC040 | CC040B |
| Coiling Temperature | 650 | 650 |
| Tension Leveling Elongation | 1% | 1% |
| Chemistry | | |
| C | 0.041 ± 0.003 | 0.041 ± 0.004 |
| N | 0.0057 ± 0.0008 | 0.0038 ± 0.0007 |
| B | 0 | 0 |
| Ti | 0.0012 ± 0.0005 | 0.018 ± 0.003 |
| N* | 0.0054 ± 0.0007 | |
| BxN* | 0 | 0 |
| Stabilization Ratio | 0.085 ± 0.029 | 1.41 ± 0.31 |
| Orientation | Longitudinal | Longitudinal |
| Mechanical Properties | | |
| Count | 66 | 776 |
| Yield Strength | | |
| Avg | 36.8 | 34.2 |
| Std Dev | 2.0 | 1.9 |
| Min | 32.8 | 28.1 |
| Max | 42.2 | 43.0 |
| Tensile Strength | | |
| Avg | 52.2 | 50.1 |
| Std Dev | 1.4 | 1.3 |
| Min | 49.4 | 46.6 |
| Max | 57.0 | 61.1 |
| Total Elongation | | |
| Avg | 40.8 | 43.2 |
| Std Dev | 2.7 | 2.7 |
| Min | 30.0 | 24.8 |
| Max | 46.5 | 50.8 |
| n value | | |
| Avg | 0.198 | 0.208 |
| Std Dev | 0.013 | 0.010 |
| Min | 0.165 | 0.160 |
| Max | 0.230 | 0.243 |
| Sliver Frequency | | |
| Average | 0.0 | 0.0 |
| Std Dev | 0 | 0 |
| Processing | | |
| Grade Type | LCAK + Ti | LCAK + B |
| Grade | CC041 | CC846EX |
| Coiling Temperature | 650 | 650 |
| Tension Leveling Elongation | 1% | 0.5% & 1.0% |

TABLE 1-continued

| | | |
|---|---|---|
| Chemistry | | |
| C | 0.041 ± 0.004 | 0.045 ± 0.002 |
| N | 0.0037 ± 0.0008 | 0.0044 ± 0.0003 |
| B | 0 | 0.0037 ± 0.0003 |
| Ti | 0.014 ± 0.003 | 0.0015 ± 0.0003 |
| N* | | .0039 ± 0.0004 |
| BxN* | 0 | 1.46E-5 ± 0.24E-5 |
| Stabilization Ratio | 1.12 ± 0.23 | 1.21 ± 0.09 |
| Orientation | Longitudinal | Longitudinal |
| Mechanical Properties | | |
| Count | 62 | 116 |
| Yield Strength | | |
| Avg | 34.9 | 30.1 |
| Std Dev | 1.4 | 1.5 |
| Min | 31.0 | 26.2 |
| Max | 38.2 | 34.2 |
| Tensile Strength | | |
| Avg | 50.4 | 48.2 |
| Std Dev | 0.9 | 1.1 |
| Min | 47.8 | 44.9 |
| Max | 53.0 | 50.9 |
| Total Elongation | | |
| Avg | 43.1 | 43.7 |
| Std Dev | 2.5 | 2.6 |
| Min | 34.8 | 36.2 |
| Max | 48.0 | 50.6 |
| n value | | |
| Avg | 0.206 | 0.208 |
| Std Dev | 0.009 | 0.009 |
| Min | 0.186 | 0.180 |
| Max | 0.226 | 0.225 |
| Sliver Frequency | | |
| Average | 0.0 | 41.9 |
| Std Dev | 0 | 28.2 |
| Processing | | |
| Grade Type | LCAK + Ti/B | |
| Grade | CC040F | |
| Coiling Temperature | 650 | |
| Tension Leveling Elongation | 0.5% & 1.0% | Min/Max |
| Chemistry | | |
| C | 0.042 ± 0.005 | |
| N | 0.0033 ± 0.0007 | |
| B | 0.0018 ± 0.0002 | |
| Ti | 0.0058 ± 0.0020 | |
| N* | 0.0016 ± 0.0007 | −0.0002/0.0035 |
| BxN* | 2.85E-6 ± 1.27E-6 | −0.5E-6/6.4E-6 |
| Stabilization Ratio | 1.28 ± 0.030 | 0.7/2.4 |
| Orientation | Longitudinal | Transverse |
| Mechanical Properties | | |
| Count | 739 | 575 |
| Yield Strength | | |
| Avg | 31.5 | 33.1 |
| Std Dev | 1.9 | 1.9 |
| Min | 26.4 | 28.4 |
| Max | 39.9 | 43.1 |
| Tensile Strength | | |
| Avg | 48.2 | 48.3 |
| Std Dev | 1.4 | 1.4 |
| Min | 43.3 | 37.0 |
| Max | 52.5 | 53.9 |
| Total Elongation | | |
| Avg | 43.5 | 41.5 |
| Std Dev | 2.5 | 2.9 |

TABLE 1-continued

| | | |
|---|---|---|
| Min | 29.1 | 27.4 |
| Max | 53.2 | 50.3 |
| n value | | |
| Avg | 0.201 | 0.200 |
| Std Dev | 0.012 | 0.009 |
| Min | 0.165 | 0.168 |
| Max | 0.263 | 0.223 |
| Sliver Frequency | | |
| Average | 0.9 | |
| Std Dev | 2.2 | |

The embodiments of the invention in which an exclusive property or privilege is claimed are defined as follows:

1. A method of producing a hot rolled steel sheet having a yield strength measured in a transverse direction of less than about 43 ksi, from molten steel, said sheet having increased formability and low slivering, the method comprising the steps of:

a) measuring the total nitrogen concentration of the molten steel, said total nitrogen concentration consisting of a first portion and a second portion of nitrogen;

b) adding a sufficient amount of titanium to the molten steel to bind with said first portion of the total nitrogen to form TiN, thereby leaving said second portion of total nitrogen;

c) adding a sufficient amount of boron to the molten steel to bind with the second portion of the total nitrogen to form BN; and, d) hot rolling the steel.

2. A method of producing a hot rolled steel sheet having a yield strength measured in a transverse direction of less than about 43 ksi, from molten steel, said sheet having increased formability and low slivering, the method comprising the steps of:

a) measuring the total nitrogen (N) concentration of the molten steel;

b) adding a sufficient amounts of titanium (Ti) to the molten steel to bind with a first proportion of the nitrogen to form TiN, thereby leaving a second portion of total nitrogen;

c) adding a sufficient amount of boron (B) to the molten steel to bind with the second portion of the total nitrogen to form BN; and, d) hot rolling the steel;

wherein the amount of Ti added is sufficient to reduce the amount of the second portion of total nitrogen to a concentration within the range of:

$$0.0005 \text{ wt } \% \leqq N^* \leqq 0.0025 \text{ wt } \%$$

where:

N* is the second portion of total nitrogen and wherein:

$$N^* = N_{tot} - (Ti/3.42);$$

Ntot is the total nitrogen as measured in wt %; and,

Ti is the amount of titanium added in wt %.

3. The method of claim 2 wherein the amount of N* is about 0.0012 wt % to about 0.0022 wt %.

4. The method of claim 3 wherein the amount of boron added to the molten steel is about 0.0005 wt % to about 0.0025 wt %.

5. The method of claim 4 wherein the amount of boron added to the molten steel is about 0.001 wt % to about 0.002 wt %.

6. A method of producing a low yield strength hot rolled steel sheet having a yield strength measured in a transverse direction of less than about 43 ksi, from molten steel, said steel sheet having increased formability and low slivering, the method comprising the steps of:

a) measuring the total nitrogen concentration of the molten steel;

b) adding sufficient amounts of titanium and boron to the molten steel such that said titanium and boron bind with the total amount of nitrogen contained in the molten steel, said titanium and boron being provided in a proportion wherein the range of a stabilization ratio, SR corresponding to the relationship:

$$(B/0.77 + Ti/3.42)/N_{tot}$$

is $$0.7 \leqq SR \leqq 2$$

where:

$N_{tot}$ is the total nitrogen as measured in wt % and the range of the boron bound to nitrogen remaining after Ti addition, B×N* is $$0 \text{ wt } \%^2 < B \times N^* \leqq 4.5 \times 10^{-6} \text{ wt } \%^2;$$

where:

$$N^* = N_{tot} - (Ti/3.42); \text{ and}$$

c) hot rolling the steel.

* * * * *

UNITED STATES PATENT AND TRADEMARK OFFICE

CERTIFICATE OF CORRECTION

PATENT NO. : 7,005,016 B2
APPLICATION NO. : 10/023639
DATED : February 26, 2006
INVENTOR(S) : Maria-Lynn Turi and Stephen Lynes It is certified that error appears in the above-identified patent and that said Letters Patent is hereby corrected as shown below:

Title Page, Item (57) Abstract

Line 2, Replace “silver” with -- sliver --.

Signed and Sealed this

Twenty-first Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,005,016 B2
APPLICATION NO. : 10/023936
DATED : February 28, 2006
INVENTOR(S) : Maria-Lynn Turi and Stephen Lynes It is certified that error appears in the above-identified patent and that said Letters Patent is hereby corrected as shown below:

Title Page, Item (57) Abstract

Line 2, Replace “silver” with -- sliver --.

This certificate supersedes Certificate of Correction issued November 21, 2006.

Signed and Sealed this

Twenty-third Day of January, 2007

JON W. DUDAS
*Director of the United States Patent and Trademark Office*